United States Patent [19]

Jentzsch et al.

[11] Patent Number: 4,896,602

[45] Date of Patent: Jan. 30, 1990

[54] METHOD OF AND A CIRCUIT FOR METERING INK IN PRINTING MACHINES

[75] Inventors: Arndt Jentzsch; Wolfgang Mueller, both of Coswig; Falko Missbach, Meissen; Volker Eichler, Weinboehla, all of German Democratic Rep.

[73] Assignee: Veb Kombinat Polygraph "Werner Lamberz" Leipzig, Leipzig, German Democratic Rep.

[21] Appl. No.: 213,618

[22] Filed: Jun. 30, 1988

[30] Foreign Application Priority Data

Jul. 1, 1987 [DD] German Democratic Rep. ... 304412

[51] Int. Cl.[4] ..... B41F 31/06; B41L 27/08

[52] U.S. Cl. ..... 101/350; 101/483

[58] Field of Search ..... 101/350, 349, 351, 352, 101/148, 363, 483

[56] References Cited

U.S. PATENT DOCUMENTS 4,765,241 8/1988 Hank ..... 101/350

FOREIGN PATENT DOCUMENTS 125618 3/1976 Fed. Rep. of Germany ..... 101/350

*Primary Examiner*—J. Reed Fisher

*Attorney, Agent, or Firm*—Michael J. Striker

[57] ABSTRACT

A stepper drive for an ink doctor roller of a rotary printing machine is power supplied by incremental voltages of uniform magnitude derived from the rotary speed of the machine. The magnitude of an ink metering step of the doctor roller is selected in an evaluation unit which determines the number of incremental voltages supplied to the stepper drive. At the same time, the rate of the selected metering steps is selected in dependency on the rotary speed of the machine by a rate selection means.

6 Claims, 2 Drawing Sheets

METHOD OF AND A CIRCUIT FOR METERING INK IN PRINTING MACHINES

BACKGROUND OF THE INVENTION

The present invention relates to a method of and a circuit arrangement for dosing or metering in a printing machine having an ink fountain engaging a doctor roller driven by a separate motor.

The metering of printing ink according to different printing applications by means of an ink fountain provided with an ink blade adjustable by zone screws and being in adjustable engagement with an ink doctor roller which cooperates with an ink lifter roller is known since long time. To meet the general requirement for continuously increase the printing efficiency, a large number of improvements in this field have been recently developed which, however, are frequently very complicated in their design.

From the DD Pat. No. 212,475 a solution is known in which an ink film is metered on the doctor roller by the adjustment of zone screws acting on the ink blade. The ink lifter roller cyclically takes off the ink film from the doctor roller and transfers the same to the first ink distributing cylinder. The ink lift roller is oscillated by a cam roller control in such a manner that at each 2.5 rotation of the printing plate cylinder of the machine a contact with the doctor roller and the first distributing cylinder takes place. By means of an electrical control activated by a selector switch it is possible to change the rate of swinging of the ink lifter roller such that each fifth or tenth rotation of the printing plate cylinder it engages once the ink doctor roller.

By means of this known device a satisfactory ink metering for most applications is achievable. Its disadvantage, however, is the fact that the time of the engagement of the ink lifter roller is not adjustable and consequently the ink metering cannot be adjusted with sufficient sensitivity.

In an ink metering device according to DE-AS 1,761,394 the ink doctor roller is driven at a constant rotary speed ratio with respect to the printing machine and ink is transferred by an ink lifter roller onto the first ink distributing cylinder. The engagement times of the ink lifter roller on the doctor roller as well as on the first ink distributing cylinder are adjustable by means of two timing device which cooperate with a change-over device. This construction consists of a large number of component parts and is very complex in design thus resulting in high manufacturing costs. An accurate reproducibility of a previously adjusted metering is not achievable.

A device for ink metering has been also devised in which the ink is taken off by a milling roller rotating at the speed of the printing machine and being arranged at a minute distance from a swichtable ink doctor roller. An ink lifter roller picks off the ink layer from the milling roller and transfers the layer to the first ink distributing cylinder. With this device an adequate ink metering is obtained. Its disadvantage is its large cost of construction and consequently high manufacturing costs.

SUMMARY OF THE INVENTION

It is, therefore, a general object of the present invention to overcome the aforementioned disadvantages.

In particular, it is an object of this invention to provide a method and a circuit arrangement for controlling the printing ink metering which improves quality and reduces manufacturing costs.

Another object of this invention is to provide such an improved method and circuit arrangement which enables to meter ink in finest steps and to reproduce a preceding adjustment with a high accuracy.

Still another object of this invention is to eliminate the ink lifter roller and its control which hitherto has been conventional in prior art inking mechanisms.

In keeping with these objects and others which will become apparent hereafter, one feature of this invention resides in a method in which the ink doctor roller performs a metering step in sequence of discrete angular steps of uniform amplitude and an ink transfer roller is adjusted for taking off the corresponding ink layer from the doctor roller. The number of the consecutive angular motions of the uniform magnitude is adjustable to obtain ink metering steps of different magnitudes. Also the ordinal number of machine cycles after which a metering step is performed, is selected.

It is advantageous when an ink metering step is selectively initiated after every second, fourth, or eighth machine cycle.

By means of the circuit arrangement of this invention, the ink doctor roller is driven by a stepper drive consisting of a pulse distributor, a power amplifier and an electric stepper motor. An increment voltage generator coupled with the printing machine is connected to an input of an AND gate whose output is connected to the pulse distributor. The other input of the AND gate is connected to a latch or binary store whose setting input is connected to a first selection means including a time preselection unit and a time preparation unit. The output of the time preselection unit is connected to a setting input of the latch or binary store whose output is connected to the other input of the first mentioned AND gate for controlling the power supply of the stepper drive. The output the time preselection unit is further connected to an input of another AND gate whose other input is connected to the output of the increment voltage generator. The output of the other AND gate is connected to second selection means including a counter, a comparator and a binary coded decimal switch. The output of the comparator is connected to the resetting inputs of the counter and of the binary store.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
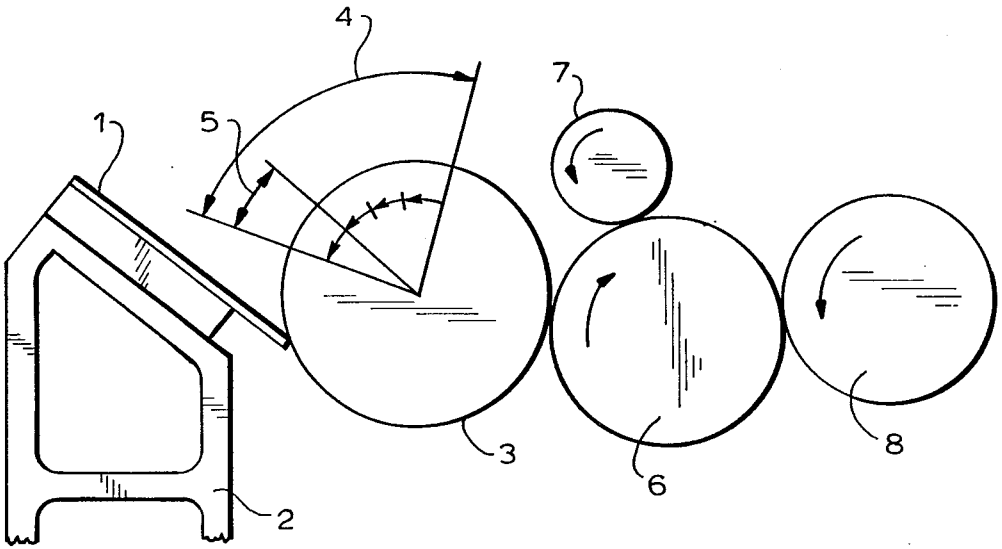
FIG. 1 is a schematic representation of a part of an inking mechanism of a rotary printing machine.

Referring firstly to the part of the inking mechanism shown in FIG. 1, an ink blade 1 of an ink fountain 2 cooperates with an ink doctor roller 3 whereby the adjustment of the engagement of the ink plate 1 with the doctor roller 3 is carried out by non-illustrated adjusting means. The doctor roller 3 is rotated stepwise by a separate stepper drive controlled by a circuit arrangement illustrated by way of an example in FIG. 2.

Each dosing or metering step 4 performed by the doctor roller 3 consists of a selectable number of angular increments 5. In addition, it is also selectable at what rate or frequency the metering steps 4 are to be executed, that means whether after each second, fourth or eighth rotation of the printing plate cylinder of the machine for example, a metering step 4 should take place. An ink transfer roller 6 rotating for example at the speed of the printing machine takes a layer of ink of certain thickness from the doctor roller 3. The rider roller 7 engages the ink transfer roller 6 and its function is to intercept sprayed ink and distribute the same on the ink transfer roller. The ink is transferred from the transfer roller 6 onto the first ink distributing roller 8 and therefrom reaches via a non-illustrated pack of rollers the printing plate cylinder of the machine.

Figure 2:
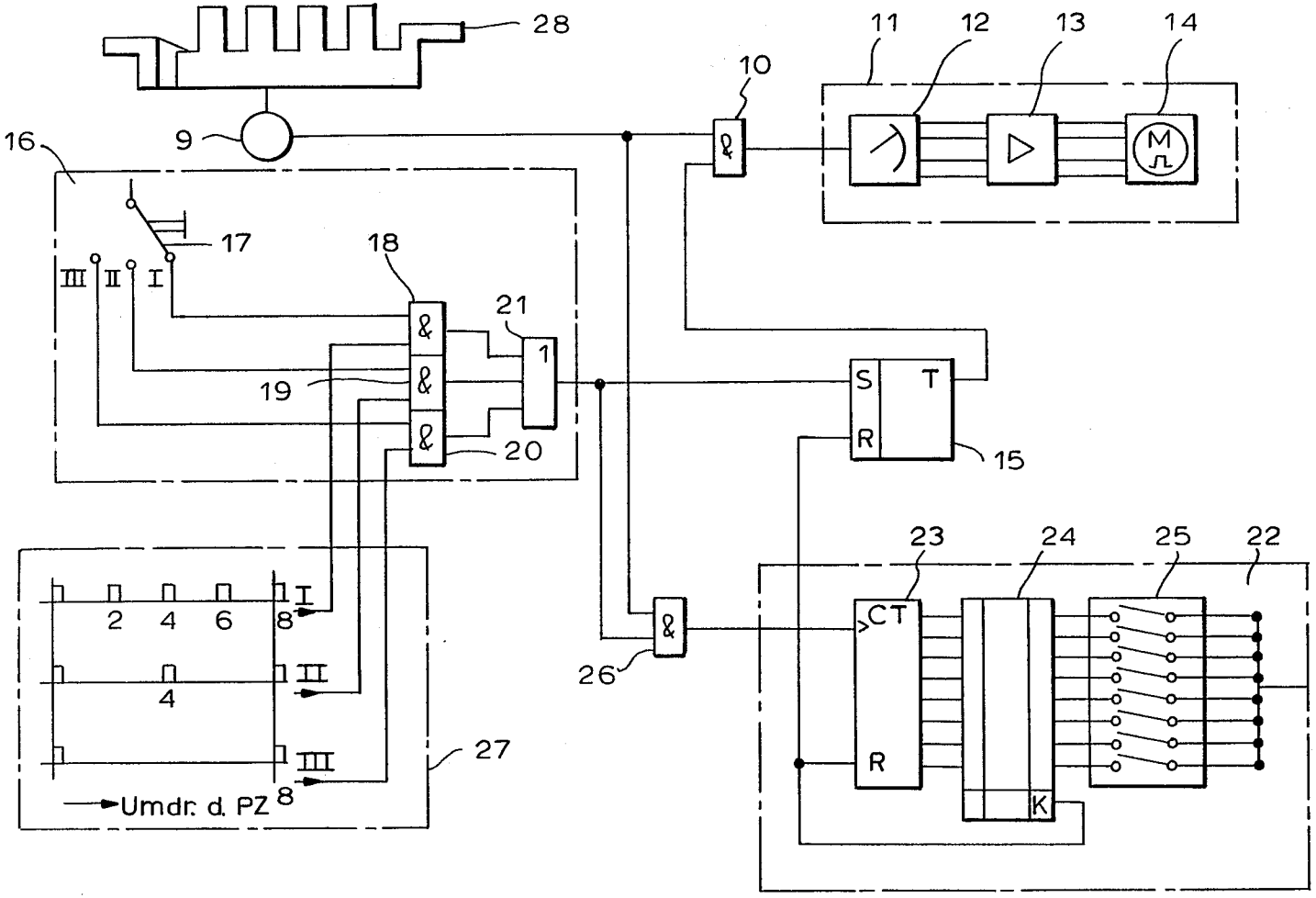
FIG. 2 is a schematic diagram of a circuit arrangement for controlling the ink metering in the mechanism of FIG. 1.

Referring to FIG. 2, the stepwise drive of the doctor roller 3 is effected as follows: An increment signal generator 9 is coupled with the drive of the printing machine 28 and its output is connected to an input of an AND gate 10 whose output is connected to a stepper drive 11. The stepper drive consists of a series connection of a pulse distributor 12, a power amplifier 13 and an electric stepper motor 14.

The other input of the AND gate 10 is connected to the output of a latch or binary store 15. The setting input of the store 15 is connected to the output of a time preselection unit 16 of a rate selection means which includes a time preparation unit 27. The time preselection unit 16 consists of a selector switch 17 whose contacts are connected to first inputs of assigned AND gates 18, 19 and 20. The outputs of respective AND gates are connected to inputs of an OR gate 21 whose output forms the output of the rate selection means. The resetting input of the binary store 15 is connected to the output of an evaluation unit 22 constituting additional selection means for setting the magnitude of the metering step. The evaluation unit 22 consists of a counter 23 whose parallel outputs are connected to a set of inputs of a comparator 24. Another set of inputs of the comparator is connected to a binary coded decimal selector switch 25. The output K of the comparator 24 is connected to the resetting input of the counter 23 and to the resetting input R of the binary store 15.

The counting input CT of the counter 23 is connected to an output of an AND gate 26 whose one input is connected to the output of the increment signal generator 9 and other input is connected to the output of the time preselection unit 16.

The time preparation unit 27 in the rate selection means delivers at its three outputs I, II and III which are connected to the other inputs of the AND gates 18 through 20, different series of timing pulses which are related to the rotary speed of the printing machine. For example, output I delivers a pulse after every two rotations of the printing plate cylinder. Output II delivers a pulse after every four rotations of the printing plate cylinder, and output III delivers a pulse after every eight rotations of the printing plate cylinder. The corresponding contacts I, II and III of the selector switch 17 determine the rate or frequency of the pulses at the output of the time, preselection unit 16.

The operation of the ink metering control circuit arrangement of the invention is as follows: Firstly, a desired number of individual uniform angular increments 5 determining the length of the metering step 4 is selected by means of the second selector switch 25 of the evaluation unit 22. Then, by means of the first selector switch 17 the rate of the metering step 4 is determined that means it sets after how many rotations of the printing plate cylinder of the machine 28 the ink doctor roller 3 is to perform one metering step 4.

The power supply for the stepper drive 11 is controlled by the increment signal generator 9 which delivers under the control of the AND gate 10 a series of pulses derived from the rotary speed of the printing machine 28. The pulse distributor 12 adjusts the rate of the pulses at the output of AND gate 10 to the rate of the uniform angular increments 5, amplifier 13 amplifies the distributed pulses and supplies the same to the stepper motor 14 which imparts the corresponding stepping motion to the doctor roller 3. The binary store 15 is periodically set by pulses from the output of the time preselection unit 16 at a rate selected by the first selector switch 17, that means each second, or fourth or eighth rotation of the printing plate cylinder. The same pulse from the output of the time preselection unit 16 is applied to the other input of the AND gate 26 which in the presence of an incremental voltage at the output of generator 9 delivers a pulse to the counter 23. As mentioned before, comparator 24 keeps comparing the count at the output of the counter with a binary coded decimal number preselected by the switch 25 and as soon as the count is identical with the preselected number the output K of the comparator 24 delivers a resetting pulse applied both to the resetting input of the counter 23 and to the binary store 15 and resets the outputs of the two units to zero thus causing the stoppage of the stepper motor 14 of the drive 11 until a new increment voltage from the generator 9 occurs simultaneously with a pulse from the binary store 15 at the inputs of the AND gate 10. In this manner, the metering of the ink from the fountain 2 by setting the number of uniform angular increments 5 and the rate of the metering steps 4 by selector switches 17 and 25 can be finely metered.

What is claimed as new and desired to h=protected by Letters Patent is set forth in the appended claims:

1. A circuit arrangement for controlling the ink metering in a printing machine operating in cycles and having an inking mechanism including an ink fountain, a doctor roller in engagement with the fountain, an electric stepper drive for driving the doctor roller at a relatively low speed in discrete angular increments of a uniform magnitude to withdraw from the fountain a layer of ink, comprising, an increment voltage generator coupled to the printing machine for generating a series of pulses related to the rotary speed of the machine, a first AND gate having an input connected to the output of said increment voltage generator and an output connected to said stepper drive, rate selection means including a time preselection unit having an output connected to a setting input of a binary store, the output of said binary store being connected to a second input of said first AND gate, the output of said increment voltage generator being connected to an input of a second AND gate and the output of said time preselection unit being connected to the a second input of said second AND gate and an output of said second AND gate being connected to a means for selecting the magnitude of a metering step, said magnitude selecting means predetermined number of pulses is delivered by said increment voltage generator.

2. A circuit arrangement as defined in claim 1, wherein said stepper drive includes a series connection of a pulse distributor, a power amplifier and an electric stepper motor powered by said amplifier and being coupled to said doctor roller.

3. A circuit arrangement as defined in claim 2, wherein said time preselection unit includes a selector switch, a plurality of third AND gates each having an input connected to an assigned contact of the selector switch and an output connected to an assigned input of an OR gate, a time preparation unit having a plurality of outputs each delivering a series of pulses at different rates correlated to the rotary speed of the printing machine, each of the outputs, of the time preparation unit being connected to a second input of the assigned third AND gate in the time preselection unit and the output of said OR gate in the time preselection unit being connected to the setting input of the binary store and to the second input of said second AND gate.

4. A circuit arrangement defined in claim 3, wherein said magnitude selection means includes a counter having a counting input connected to the output of said second AND gate and a plurality of outputs connected to a set of inputs of a comparator, another set of inputs of said comparator being connected to a second selector switch for selecting a desired number of said discrete angular increments whereby when the count at the output of said counter equals the number preselected by said second selector switch said comparator delivers a resetting signal to said counter and to said binary store.

5. A method of metering ink in a printing machine which operates in cycles comprising the steps of providing a printing machine with an operating cycle rate, an inking mechanism including an ink fountain, a doctor roller in engagement with the fountain, a separate stepper drive for driving the doctor roller at relatively low speed in discrete angular increments of a uniform magnitude, and an ink transfer roller in engagement with the doctor roller to withdraw therefrom a layer of ink; generating a series of pulses at a pulse rate corresponding to a preselected ratio of the operating cycle rate of the printing machine; feeding said series of pulses to said stepper drive to initiate an ink metering step; counting the pulses in said series to obtain an actual count thereof; providing a preselected desired count of pulses; comparing the actual count of said series of pulses with sow preselected desired count of pulses and, when the two counts are equal, stopping the feeding of said series of pulses to said stepper drive to terminate said ink metering step.

6. A method as defined in claim 5, wherein said ratio of the operating cycle rate of the printing machine to the pulse rate of said series is selected from values 2, 4 and 8.

* * * * *